US006148170A

United States Patent [19]

McMindes et al.

[11] Patent Number: 6,148,170

[45] Date of Patent: Nov. 14, 2000

[54] FUSER ROLLER HAVING A THICK WEARABLE RELEASE LAYER

[75] Inventors: Michael McMindes, Rochester; James Montgomery, Bergen, both of N.Y.

[73] Assignee: Illbruck GmbH, Germany

[21] Appl. No.: 09/400,165

[22] Filed: Sep. 21, 1999

[51] Int. Cl.[7] ..... G03G 15/20

[52] U.S. Cl. ..... 399/330; 399/330; 492/56

[58] Field of Search ..... 399/330, 333; 492/16, 53, 56; 219/216

[56] References Cited

U.S. PATENT DOCUMENTS

| | | | |
|---|---|---|---|
| 4,842,944 | 6/1989 | Kuge et al. | 219/216 X |
| 4,887,964 | 12/1989 | Takeuchi . | |
| 5,035,950 | 7/1991 | Del Rosario . | |
| 5,227,853 | 7/1993 | Proulx et al. . | |
| 5,354,612 | 10/1994 | Miyabayashi | 399/328 X |
| 5,520,600 | 5/1996 | Fukumoto . | |
| 5,530,536 | 6/1996 | Henry et al. . | |
| 5,534,347 | 7/1996 | Chen et al. . | |
| 5,547,759 | 8/1996 | Chen et al. . | |
| 5,568,241 | 10/1996 | Creutzmann et al. . | |
| 5,582,917 | 12/1996 | Chen et al. . | |
| 5,629,061 | 5/1997 | Kass . | |
| 5,709,949 | 1/1998 | Chen . | |
| 5,716,714 | 2/1998 | Chen et al. . | |
| 5,782,730 | 7/1998 | Kawasaki et al. . | |
| 5,837,340 | 11/1998 | Law et al. . | |
| 5,839,038 | 11/1998 | Kopp et al. . | |
| 5,851,673 | 12/1998 | Chen et al. . | |
| 5,906,881 | 5/1999 | Chen et al. . | |
| 5,950,061 | 9/1999 | Ota et al. . | |

OTHER PUBLICATIONS

The World of Printers, The Technologies of the High Performance Printers of Oce' Printing Systems GmbH, Non–Impact Printing Technologies, Nov. 1998, Edition 3a, Germany.

Dow Corning Corp., Information About High Technology Products, Silastic E RTV Silicone Rubber, 1993, Midland, Michigan.

*Primary Examiner*—Quana M. Grainger

*Attorney, Agent, or Firm*—Harter, Secrest & Emery LLP; Stephen B. Salai, Esq.; Joseph M. Young, Esq.

[57] ABSTRACT

A fusing roller for use in image transfer devices, wherein toner is fixed by heat and pressure to a receiver by a pair of rollers. The fusing roller has a core, a base layer of conductive silicone rubber and a release layer consisting of a silicone rubber compound. The particular surface material offers excellent toner release and continuously renews its surface.

30 Claims, 1 Drawing Sheet

FUSER ROLLER HAVING A THICK WEARABLE RELEASE LAYER

FIELD OF THE INVENTION

This invention relates to toner fusing rolls. More specifically, it relates to such rolls that have a silicone rubber base coating and an outer toner release material.

BACKGROUND OF THE INVENTION

Developed toner images in electrostatographic processes can be transferred and fused to another substrate such as paper. Transfer of the toner image can be accomplished by electrostatic methods, pressure contact, or other means. Once transferred, the toner image can be fused or fixed to the paper. The fusing step commonly consists of passing the paper on which toner powder is distributed in an imagewise pattern, through the nip of a pair of rolls, at least one of which is heated. The heated roller is often referred to as a fusing roller.

Toner fusing rolls have a cylindrical core, which may contain a heat source in its interior, and a resilient covering layer formed directly or indirectly on the surface of the core. Roller coverings are commonly fluorocarbon polymers or silicone polymers, such as poly(dimethylsiloxane) polymers, of low surface energy that minimize adherence of toner to the roller.

Frequently release oils composed of, for example, poly (dimethylsiloxanes), are also applied to the roller surface to prevent adherence of toner to the roller. Such release oils may interact with the roller surface upon repeated use and in time cause swelling, softening and degradation of the roller. Silicone rubber covering layers, which are insufficiently resistant to release oils and cleaning solvents, are also susceptible to delamination of the roller cover after repeated heating and cooling cycles. The degradation due to the combination of oil interaction and repeated heating and cooling eventually render the roller useless. It is desirable to increase this lifetime as long as possible.

Another persistent problem in this operation is that when the toner is heated during contact with the fusing roller, it may adhere not only to the paper but also to the fusing member. Any toner remaining adhered to the member can cause a false offset image to appear on the next sheet and can also degrade the fusing roller. Any toner or dirt stuck to the roller should be easily removable.

In the past, fusing rollers often had to be cleaned several times before their useful life ran out. This meant that printing time was wasted while somebody physically opened the machine and wiped down the fusing roller. In the case of the high-speed reel paper printers we tested the roller in, the fusing rollers had to be cleaned once every 25,000 copies. This translates to about every 2 days or so, the printers had to be opened and the fusing rollers cleaned. This cleaning was necessary in spite of the fact that the machines had an internal cleaning web which wiped the surface down and applied oil. In addition, the fusing rollers were changed altogether every 250,000 copies, or every 2 weeks or so.

SUMMARY OF THE INVENTION

The invention relates to multilayer soft fusing rollers. The fusing roller has a core, particularly tubular-shaped aluminum, a base cushion layer, particularly Dow Corning Silastic 8990, and an outer wearable release layer, particularly GE/Toshiba Silicone TSE-322.

The fusing roller described in detail below offers a much better toner release than prior fusing rolls. This is true in part because of the softness of the roller. The softness of the outer layer is a result of the hardness of the rubber and the thickness of the coating surrounding the core. This coating is comprised of the base cushion layer and the wearable outer release layer. The thicknesses that we found suitable for the coating ranged between 300 $\mu$m and 600 $\mu$m, with a thickness of 500 $\mu$m optimally. To further optimize the superior functionality of this coating, this coating is divided equally between base layer and surface layer It should be noted that these thicknesses were for printer speeds of between 120 and 500 pages of A4 paper per minute. At slower speeds, thicker coatings should be considered.

The release layer requires little or no cleaning. The abraded silicone is either cleaned off the roller with the cleaning web or is carried out on the paper (abrading media). The cleaning web is a feature of the OPS printer.

This configuration for the roller is particularly adapted for web printers generally, and more specifically for use in OPS printing systems. With the incorporation of U.S. Pat. No. 5,839,038 (wrap around drum) the toner is pre-softened prior to entering the fusing nip. The paper also stays in extended contact with the fusing roller. In addition, the web actually pulls itself off the fuser after it has exited the nip.

Also, this printer, like others has internal oil applicator. Essentially oil seeps from a pan onto a felt cloth that slides very slowly across the fusing roller. In addition to supplying oil to the surface of the fusing roller, the felt carries away the bulk of the worn surface of the roller.

DETAILED DESCRIPTION OF THE PREFERRED EMBODIMENTS

The invention is a new fusing roller. More specifically, the invention is a fusing roller that includes a new surface coating that gives the fusing roller a much longer lifetime than prior fusing rolls. It also gives the roller self-cleaning properties.

In the following paragraphs, I have used the term paper generally for toner receivers. It will be apparent to those with skill in the art that other materials such as textiles, plastics, etc. are equivalent to paper for the purposes of this invention.

The original intention was to create a soft fusing roller with the ability to fix high resolution (600 dpi) images with a matte finish within the confines of their existing machine at a process speed of 0.6 m/s or 240 pages per minute and a lifetime of 2 million pages. The present invention satisfies these requirements.

The Preferred Embodiment

Figure 1:
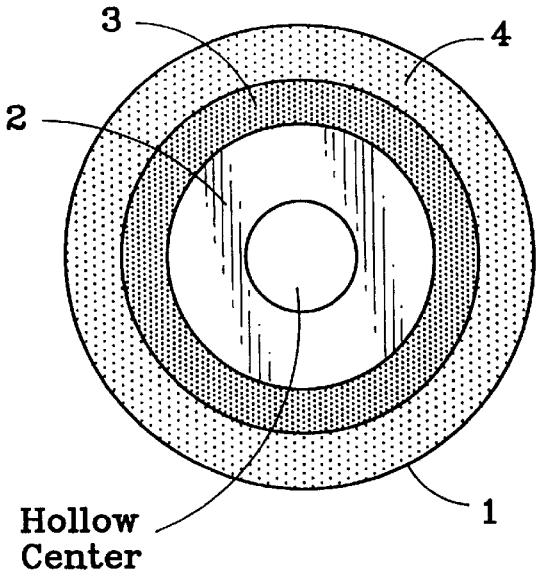
FIG. 1 shows an end view of one embodiment of a fusing roller.

FIG. 1 depicts the preferred embodiment of a fusing roller. The fusing roller illustrated is composed of a core 2, a base cushion layer 3, and an outer wearable release layer 4.

The core 2 is made of hollow aluminum, however, any rigid substrate will suffice for the purposes of this invention.

The core may be made out of other metals commonly used for cores, such as steel or nickel. The core of the roller displayed in FIG. 1 is hollow so as to allow a heating element to be inserted into the core. A heating element is used to facilitate the process of setting toner on a sheet of paper. However, the core does not have to be hollow. In some cases, if some other method of heating the toner is used, the fuser core may also be solid.

The core is surrounded by a base cushion layer (or layers) 2 of Dow Corning Silastic 8990, a silicone rubber compound made by Dow Corning located in Midland, Mich. The base layer may be one individual layer or a group of stacked sublayers. Base cushion layer(s) increase the compliancy of the fusing member. The presently preferred embodiment of the fusing roller system is to have a rather noncompliant fusing roller and a more compliant pressure roller. This is relatively speaking. What it means is that the pressure roller is the one that deforms to create a nip width into which a toner receiver may be admitted. Silicone rubber compounds are commonly used as base layers in fusing rolls. The base layer is also a good conductor of heat. This is necessary for the heating element inside the core to sufficiently heat the surface.

For the base layer 3, we found that substances with a hardness of between 45 A and approximately 60 A were acceptable. The corresponding thermal conductivity range of these materials should be approximately 0.5–0.7 W/mK. Dow Corning 8990 was one of several materials tested, but Dow Corning 8990 was used because of ease of processing. It should be understood that, even where not explicitly noted, the use of Dow Corning 8990 in a claim includes any substance which is chemically similar to or obvious from the makeup of Dow Corning 8990.

Next, a wearable release layer 4 is distributed on the surface of the base layer. The release layer 4 is made of GE TSE-322, made by GE Silicones located in Waterford, N.Y. It is a trade secret protected one component silicone adhesive sealant that will bond to many substrates without a primer and which will cure rapidly at elevated temperatures. It works well due to its generally poor tensile strength and filler selection, the filler selection generally being silicates. It should be understood that, even where not explicitly noted, the use of GE TSE-322 in a claim includes any substance which is chemically similar to or obvious from the makeup of GE TSE-322.

GE TSE-322 comprises approximately 30–60% vinylpolydimethylsiloxane, 10–30% of Amorphous silica, 1–5% of dimethyl hydrogen polysiloxane, 10–30% of a first trade secret material, and 1–5% of a second trade secret material.

A release layer is sufficiently wearable when the unintended retention of toner particles is substantially precluded, i.e., when the wear rate of the substance is balanced with the requirement that it is self-cleaning. In this case, we found that a wear rate of between 6,000 rev/1 $\mu$m and 10,000 rev/1 $\mu$m.

The wearable release layer has relatively high release and is used optimally in high-speed web printers. The printers we tested them in were made by Océ Printing Systems. In these printers a thickness of about 250 $\mu$m gave peak performance. Prior art printers do not have a release layer that is as thick as ours with as low a conductivity as TSE-322 has. Previous printers that had thicker release layers were made from materials that were measurably more heat conductive. This was because of internal heating. The heat would have to travel from the core through the layers to the surface. In the printer the fusing roller was tested in this is not necessary because the paper is in extended contact with the fusion roller.

An acceptable range of values for the specific gravity exists between 1.1 and 1.4. An acceptable range of values for tensile strength exists between 300 and 800 psi. An acceptable range of values for hardness exists between 35 and 60 shore A. Further it is preferable that the thickness of the release layer be between 0.7 and 1.3 times the thickness of the base layer.

Second Embodiment

Figure 2:
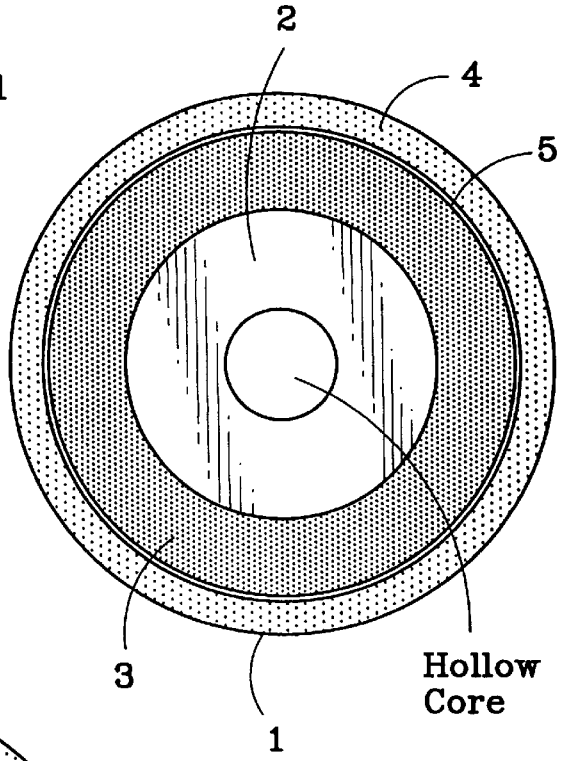
FIG. 2 shows an end view of a second embodiment of a fusing roller.

A second configuration of the invention is illustrated in FIG. 2. This configuration is for designs with a larger conductive base cushion area. If the base layer 3 is thick (above approximately 1 mm although this is somewhat design dependent), a thin barrier 5 that will prevent the seepage of any oil into the base area, needs to be added just below the wearable release layer 4.

Oil barriers are typically fluoropolymers. The adhesion of these types of coatings to silicone rubber is generally very poor, and, dependent upon the material used, additional priming is often required. The barrier coating that we tested, specifically DuPont 855-700, does not require a primer. DuPont 855-700 is a fluorinated ethylene propylene (FEP)/perfluoroalkoxy (PFA) type coating formulated as a primer for adhering PFA Teflon topcoat materials to silicone. This barrier should be about 10 $\mu$m thick.

The silicone oils, which facilitate toner release on the surface, will seep into the silicone rubber layers and cause them to swell and deform. With the thin coating design of about 0.5 mm that we have in our first embodiment it is not necessary to have such a layer. The swelling and deformity are negligible. However, if a thicker coating is used, then it is necessary because otherwise the oil would cause large enough deformations in the base layer to cause uneven toner setting on the paper.

Third Embodiment

Figure 3:
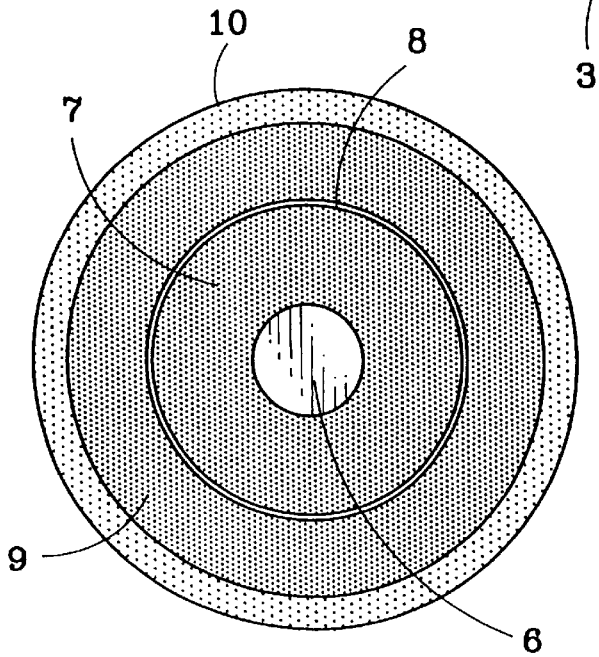
FIG. 3 shows an end view of a third embodiment of the roller.

If a heat source external to the roller is used to heat the toner, the base layer may be made thicker and more insulative. If this were done, the roller would likely be improved by adding a couple layers to the roller, as shown in FIG. 3. FIG. 3 illustrates, a core, 6 a first layer of insulative silicone 7, a second layer of material, 8 such as the PFA based coating from DuPont, that acts as an oil barrier, a third layer of thermally conductive silicone 9 on top of that, and a surface wearable release layer 10.

The insulative layer would typically have a thermal conductivity of approximately 0.2 W/mK, or the conductivity of silicone rubber without filler materials. The oil barrier 8 is necessary to prevent the silicone oils placed on the surface from seeping inside and causing the thick insulative barrier from swelling and deforming. The top second outermost layer 9 would be equivalent to the base layer 3 described in the preceding paragraphs, and the outermost layer 10 would be equivalent to the surface wearable release layer 3 described in the following paragraphs. The conductive layer should be enough to keep the roller at an effective temperature when out of contact with the fusing roller. Note, that if the top layer is made thick enough (see alternate configuration below), the oil barrier 8 layer should be placed just below the surface wearable release layer 10.

Method for Constructing Roller

First, start with a core. The core is grit-blasted. This is done to remove the oxidized surface so that it reacts better with the primer. Aluminum is used because it is both highly heat conductive and low cost. Other metals that conduct heat well would make good core materials for internally heated rollers.

Next, the surface of the core is cleaned with a solvent to prepare it for a layer of primer. The solvent used for the present roller was toluene. After the core is cleaned, a layer of primer is applied. The primer layer helps the base layer adhere to the metal core. Dow Corning Toray DY-39-051 has been used in the manufacture in successful early rollers. However, it was determined that Dow Corning P5200 works better and the cores are now primed with that. If the material chosen for the base layer contains primer, is self-priming, then this step may be left out.

Next, we apply the base cushion layer. In the present case the base cushion layer was composed of Dow Corning Silastic 8990. It is applied to the core via a blade or ring coating process. It is then cured in a convection oven for 45 minutes at 150C.

After exiting the oven, the roller is ground down to maintain its size and concentricity, and to remove the cured skin surface to promote interlayer adhesion. The roller is cleaned using a solvent. Once again, toluene was the solvent chosen for this purpose.

If an oil barrier is needed, as in the second configuration, it would be applied now. The barrier coating that was used in testing required no primer.

A top coat of wearable release material is then applied. We used GE/Toshiba Silicone TSE-322. The TSE-322 is first mixed with toluene in a 1:1 ratio to facilitate spraying. It is then applied to the base cushion layer via a spray process. The roller is then allowed to sit for 30 minutes at room temperature. This allows the residual solvent to evaporate.

The top coat is then cured for 1 hour at 150C., after which it is post-cured in a convection oven for 4 hours at 200C. It is then ground down again to maintain the size and concentricity of the roller, as well as the roughness of the surface. Also, the grinding process removes the cured skin. This helps to provide consistent surface characteristics as the roller wears.

Finally, the roller is coated with silicone oil. In this case, the oil used was AKF1000 silicone oil from Wacker Chemie in Burghausen, Deutschland. The oil had a viscosity of 10,000 cst. It is estimated that a viscosity of at least 500 cst is necessary for good results, however no tests have been done. The roller is then baked for 30 minutes at 150C. This preconditions the roller to machine conditions.

For a thicker roller, or one with an insulative layer, the base layer would be applied like the conductive layer above. Then the steps of cleaning the surface, applying primer then applying another layer would be repeated for added layers.

What is claimed is:

1. A fusing roller, comprising:

(a) a core;

(b) a thermally conductive silicone rubber forming a uniformly thick base layer on the core; and (c) a release coating on the base layer, the release coating having (i) a specific gravity between 1.1 and 1.4, (ii) a tensile strength between 300 and 800 psi, (iii) a hardness of between 35 and 55 shore A.

2. The fusing roller of claim 1, where the base layer has a hardness of less than 65 Shore A.

3. The fusing roller of claim 1, where the base layer has a thermal conductivity of between approximately 0.5 W/mK and 0.7 W/mK.

4. The fusing roller of claim 1, where the base cushion layer is comprised of a plurality of sublayers of conductive silicone rubber.

5. The roller of claim 1, where the release layer is sufficiently wearable to substantially preclude unintended retention of toner particles.

6. The roller of claim 1, where the core is made of aluminum.

7. A fusing roller, comprising:

(a) a core;

(b) a thermally conductive silicone rubber forming a uniformly thick base layer on the core; and (c) a release coating on the base layer the release coating having (i) a specific gravity between 1.1 and 1.4, (ii) a tensile strength between 300 and 800 psi, (iii) a hardness of between 35 and 60 shore A;

(d) a barrier inserted between the base layer and the release layer to prevent surface oils from reaching the base layer.

8. A fusing roller as in claim 1, where the core is tubular.

9. A fusing roller as in claim 1, where the release coating is silicone rubber.

10. A fusing roller as in claim 1, where the coating has a thickness greater than approximately 50 $\mu$m.

11. The fusing roller of claim 1, where the release coating has a specific gravity between approximately 1.25 and approximately 1.3.

12. The fusing roller of claim 1, where the release coating has a hardness between approximately 40 Shore A and approximately 50 Shore A.

13. The fusing roller of claim 1, where the release coating has a tensile strength between approximately 400 and 600 psi.

14. A fusing roller comprising:

(a) a core;

(b) a cushion layer having a substantially uniform thickness disposed on the core;

(c) a release layer on the cushion layer, the release layer having a thickness between approximately 0.7 and approximately 1.3 times the thickness of the cushion layer;

(d) The release layer being sufficiently wearable to substantially preclude unintended retention of toner particles.

15. A fusing roller as in claim 14, where a primer coating is disposed on the core before the base coat is applied.

16. The fusing roller of claim 14, where the base layer has a hardness of less than 65 Shore A.

17. The fusing roller of claim 14, where the base layer has a thermal conductivity of between approximately 0.5 W/mK and 0.7 W/mK.

18. The roller of claim 14, where the cushion layer is composed of a series of smaller sublayers.

19. A fusing roller, comprising:

(a) a core;

(b) an insulating layer of silicone rubber forming a uniformly thick base layer disposed on the core;

(c) a conductive layer of silicone compound disposed of on the base layer of silicone (d) a surface layer of release material, where the release material is sufficiently wearable to substantially preclude unintended retention of toner particles.

20. A fusing roller as in claim 19, further comprising a barrier between the conductive layer and the surface layer that prevents oils on the surface of the roller from penetrating into the conductive silicone layer.

21. A fusing roller as in claim 19, further comprising a barrier between the insulative layer and the conductive layer that prevents oils on the surface of the roller from penetrating into the insulative layer.

22. A fusing roller, comprising:

(a) a core;

(b) a cushioning layer on the core; and (c) a one component silicone adhesive sealant bonded to the cushioning layer.

23. A fusing roller, as in claim 22, where the cushioning layer is composed of Dow Corning 8990 silicone rubber compound or equivalent.

24. A fusing roller, as in claim 22, where the silicone adhesive sealant is GE TSE-322 silicone rubber compound or equivalent.

25. The fusing roller of claim 24, wherein the coating of GE TSE-322 or equivalent is greater than 50 $\mu$m thick.

26. The fusing roller of claim 22, where the sealant bonded to the cushioning layer is adhesive free.

27. An apparatus to fix a toner image on an image carrier, comprising:

(a) a fusing roller; and (b) a pressure roller, which presses the image carrier against the fusing roller;

(c) the fusing roller including:

(i) a core;

(ii) a thermally conductive silicone rubber forming a uniformly thick base layer on the core; and (iii) a release coating on the base layer, the release coating having (A) a specific gravity between 1.1 and 1.4, (B) a tensile strength between 300 and 800 psi, (C) a hardness of between 35 and 55 shore A.

28. The fusing roller of claim 22, where the silicone adhesive sealant comprises dimethyl hydrogen polysiloxane.

29. The fusing roller of claim 22, where the silicone adhesive sealant comprises vinylpolydimethylsiloxane.

30. The fusing roller of claim 22, where the silicone adhesive sealant comprises amorphous silica.

* * * * *